United States Patent [19]

Collonia

[11] Patent Number: 4,471,735

[45] Date of Patent: Sep. 18, 1984

[54] IDLING CONTROLLER, PARTICULARLY FOR AUTOMOTIVE VEHICLES

[75] Inventor: Harald Collonia, Glashütten, Fed. Rep. of Germany

[73] Assignee: VDO Adolf Schindling AG, Frankfurt am Main, Fed. Rep. of Germany

[21] Appl. No.: 503,687

[22] Filed: Jun. 13, 1983

[30] Foreign Application Priority Data

Jul. 14, 1982 [DE] Fed. Rep. of Germany ..... 3226283

[51] Int. Cl.[3] ..... F02D 11/10

[52] U.S. Cl. ..... 123/339; 123/352; 180/335; 361/51; 361/236

[58] Field of Search ..... 123/339, 352, 418, 319; 180/105 E; 361/51, 236, 239, 242

[56] References Cited

U.S. PATENT DOCUMENTS

| | | | |
|---|---|---|---|
| 4,134,373 | 1/1979 | Kibler et al. | 123/352 |
| 4,157,126 | 6/1979 | Collonia | 123/352 |
| 4,267,491 | 5/1981 | Collonia | 123/352 |
| 4,278,059 | 7/1981 | Collonia | 123/339 |
| 4,301,883 | 11/1981 | Collonia | 123/352 |
| 4,328,775 | 5/1982 | Ironside | 123/339 |
| 4,344,397 | 8/1982 | Geiger et al. | 123/352 |
| 4,352,402 | 10/1982 | Collonia | 123/352 |
| 4,356,802 | 11/1982 | Kern et al. | 123/339 |

*Primary Examiner*—Raymond A. Nelli

*Attorney, Agent, or Firm*—Martin A. Farber

[57] ABSTRACT

In an idling controller, particularly for automotive vehicles, there are present both a control amplifier with integral time portion (3) and a limiter (6) with proportional time portion. The inputs of the limiter are acted on by the correcting variable from the output of the control amplifier and by a limiter reference variable formed with the actual-speed value. The output of the limiter is fed back to an input of the control amplifier. In order to obtain the desired time action of the idling controller upon sudden drops in speed, at least one time member (12) with differential time portion is provided between the input (1) of the actual-speed value and the output of the limiter (6). The limiter (6) is so dimensioned and coupled with the output of the control amplifier (3) that, upon a drop in speed beyond a predetermined value, the correcting value (y) is controlled by the output variable of the limiter (6) (control limit).

6 Claims, 3 Drawing Figures

IDLING CONTROLLER, PARTICULARLY FOR AUTOMOTIVE VEHICLES

The present invention relates to idling controllers, particularly for automotiove vehicles, having both a control amplifier with integral time portion and a limiter with proportional time portion whose inputs are acted on by the correcting variable from the output of the control amplifier and by a limiter reference variable formed with the actual-speed value, and the output of which is fed back to an input of the control amplifier.

Such known idling controllers have a converter which converts the variable of the motor speed into a voltage. A controller with PID time action is connected to the output of the converter. The PID controller comprises a first differential amplifier having a resistor-capacitor combination at one input and a second resistor-capacitor combination between the output and the input of the differential amplifier, whereby a differential time action is produced. The first differential amplifier is coupled via a resistor to a second differential amplifier which is fed back to an input via another resistor-capacitor combination. The second input is connected to a voltage divider. A proportional-plus-integral (PI) action is produced with the second differential amplifier. The two differential amplifiers thus represent a controller with PID action. From the output of the second differential amplifier a line leads to an inverting input of a third differential amplifier whose non-inverting input is connected with the output of the converter and with a bias voltage divider. The output of the third differential amplifier is conducted as limiter to the non-inverting input of the second differential amplifier of the PID controller.

By this idling controller the contradictory requirements are satisfied that a sudden drop in speed, particularly upon release of the gas pedal or upon the connecting of an additional unit, be rapidly taken up so that the speed upon idling does not, as far as possible, drop below the predetermined desired value. For this a rapid reaction is required on the part of the member which determines the feed of the mixture to the internal combustion engine. On the other hand, the control should be as insensitive as possible to smaller excitations by disturbances, in order not unnecessarily to move the member controlling the feed of the mixture, particularly a throttle valve, and in order not to produce so-called sawing control or a self-reinforcing oscillation, a so-called bonanza effect. The former case can occur, for instance, with a so-called lambda probe control for proper preparation of the mixture, and the latter by undesired actuation of the gas pedal by the driver when the automobile lurches. In order to satisfy these contradictory requirements as far as possible, despite the unfavorable dynamic behavior of the internal combustion engine, the PID time portions of the idling controller must be carefully and individually adapted to the characteristic curve of the internal combustion engine to be controlled.

As a result of the relatively high expense for parts and the critical dimensioning and adapting of the time action of the idling controller, its manufacture is relatively expensive. Nevertheless, by the use of this known idling controller only a compromise is possible between a good evening out of the speed upon large sudden drops in speed and smooth control of the speed upon small excitations.

The limiter which the known idling controller comprises has the task of conducting, for every possible speed, the correcting variable given off by the second differential amplifier within a region which lies between the overdrive limits of the second differential amplifier. The dynamic action of the idling controller is not changed by the limiter.

The present invention performs the task of so further developing an idling controller of the aforementioned type that, with the smallest possible expense for parts and with non-critical alignment or adaptation to the characteristic curve of the internal combustion engine to be controlled, relatively large, sudden drops in speed can be rapidly intercepted or evened out, while on the other hand, in the case of smaller excitations in the vicinity of the desired idling speed, it is not unnecessarily excited by smaller disturbing variables.

This object is achieved by the invention in the manner that in the branch (5) between one input (1) of the actual-speed value and the output of the limiter (6) there is provided at least one time member (12) with differential time portion and that the limiter (6) is so dimensioned and coupled with the output of the control amplifier (3) that upon a sudden drop in speed beyond a predetermined value the correcting variable (y) follows along the output variable of the limiter (6) (operating limit $Y_2$).

In accordance with the invention, the limiter is used in a novel manner in order to change the time action of the entire idling controller structure as a function of the actual idle-speed control with the control amplifier and its time members being utilized for the formation of the correcting variable. The time members can therefore be dimensioned in such a manner that the controller is insensitive to smaller excitations by disturbances. In the case of larger changes in the speed, particularly large sudden drops in speed, there is, however, a time action which is provided by at least one additional time member in the branch betwen an input of the actual-speed value and the output of the limiter. This time member can, in particular, be developed to produce a differential time portion so that the overall structure of the idling controller produces a correcting variable which rapidly counteracts any sudden drop in the speed. This connection of an additional or different time action to the time action of the actual control amplifier with its time members is effected in the manner that, upon over-drive of the control amplifier, the limiter enters into action and feeds an amplified desired limit value into the one input of the control amplifier and thus, together with the actual-speed value, causes the controller to remain at the over-drive limit. This takes place in particular in the manner that upon a drop in speed the amplifier desired limit value is increased, which thus increases also the correcting variable, which cannot drop below the value of the lower operating limit. Therefore, in this condition of operation of the idling controller the correcting variable follows the operating limit, namely the lower operating limit which, corresponding to the time action of the limiter branch with differential time portion, sensitively does away with variations in actual-speed value.

One essential advantage of the idling controller is that the relatively sluggish time action desired to even out smaller variations in speed can be set in uncritical fashion on the time member which is connected directly with the control amplifier, which thus displays in particular integral time action. In order to even out larger sudden drops in speed on the other hand, the time action is also uncritically adjusted by the time member in the limiter branch with differential time portion. In this way manufacture, adjustment and stocks can be rationalized. Furthermore, the entire expense for structural parts for the production of an idling controller is reduced, since, in particular, a differential amplifier with the corresponding coupling members can be dispensed with.

It is particularly advantageous to develop the control amplifier (3) solely with integral time portion.

In this way, in case of smaller disturbing variables, a steady uniform control is obtained, in contradistinction to the PID controller previously necessary as idling controller.

One particularly suitable embodiment of the idling controller which is characterized by a very low cost of manufacture is as follows: An idling controller having a first differential amplifier as control amplifier and a second differential amplifier as limiter amplifier is characterized by the fact that a non-inverting input (23) of the limiter amplifier (differential amplifier 14) is acted on via a capacitor (24) by the actual-speed value and an inverting input (21) is connected with a bias voltage divider (22); that the output of the control amplifier (differential amplifier 13) is connected via a resistor (25) with the non-inverting input (23) of the limiter amplifier (differential amplifier 14); and that the output of the limiter amplifier (differential amplifier 14) is connected via a diode (26) to an inverting input (15) of the control amplifier (differential amplifier 13). By the indicated coupling of the limiter amplifier to the inverting input of the control amplifier in combination with the diode the result is obtained that only the lower operating limit is dynamically displaced so that it acts on the correcting variable upon sudden decreases in speed.

With the above and other objects and advantages in view, the present invention will become more clearly understood in connection with the detailed description of a preferred embodiment, when considered with the accompanying drawings, of which:

Figure 1:
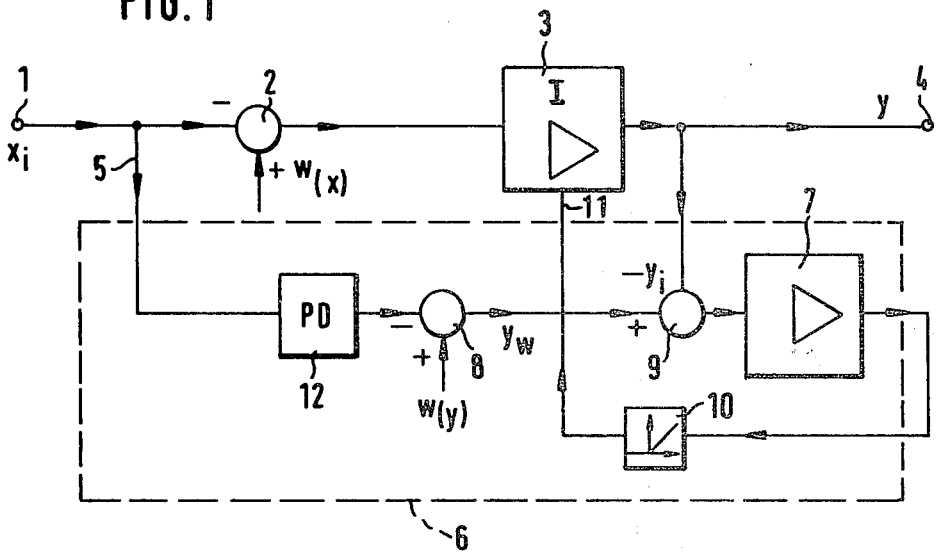
FIG. 1 is a block diagram of the idling controller.

In FIG. 1, 1 is an input into which a variable corresponding to the actual-speed value $x_i$ is fed. The input is connected to a control amplifier 3 via a comparator 2 in which the actual-speed value is compared with a reference value $w_x$. The control amplifier has exclusively integral time action as I-controller. It gives off a correcting variable $y_i$ at an output 4 to which, for instance, a drive of a throttle valve can be connected.

From the input 1 a branch 5 containing a limiter 6 also branches off. The limiter consists essentially of a limiter amplifier 7 and comparison points 8,9 which are connected in series to an input of the amplifier 7. At the comparison point 8 the difference is formed between the actual speed value or a variable derived therefrom and a reference variable $y_w$, thus producing a desired limit value. The desired limit value is compared with the correcting variable $y_i$ at the second comparison point 9.

The output of the amplifier 7 is connected via a non-linear member 10 to an input 11 of the control amplifier 3 which determines the lower operating limit.

Within the branch 5 containing the limiter 6 there is also introduced a time member 12 which in FIG. 1 lies in front of the comparison points 8 and 9 as seen in the signal-flow direction of the actual-speed value but in equivalent embodiments can also be arranged behind said comparison points and be coupled directly to the amplifier 7.

The function of the idling controller of FIG. 1 will be explained below with reference to FIG. 3.

Figure 3:
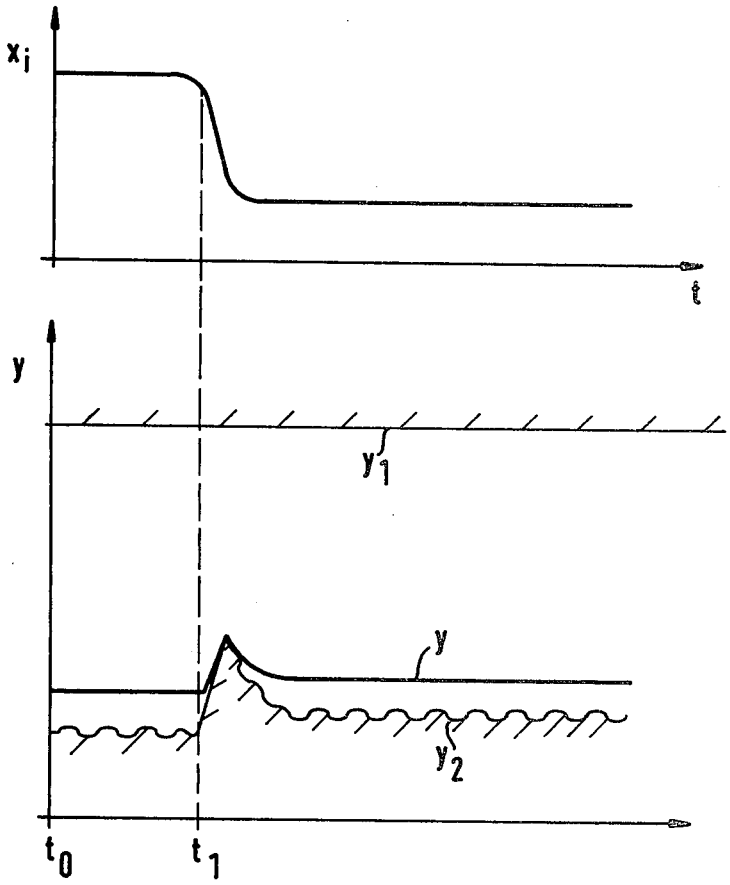
FIG. 3 is a time diagram which shows the dependence of the lower operating limit and of the correcting variable on the speed.

In FIG. 3 the correcting variable y is plotted over a time axis as abscissa between the upper constant operating limit $Y_1$ and the lower operating limit $Y_2$. Above this the actual speed $x_i$ is shown.

In the time interval $t_0$ to $t_1$ there is a relatively high actual-speed value which—in steady state—causes a correspondingly small correcting variable y. The limiter 6 acts in the following manner: The actual-speed signal which passes through the time member 12 is subtracted at the comparison point 8 from a reference value w (y). From the difference formed thereby as desired limit value $y_w$ a desired-value signal $y_i$ is subtracted at the comparison point 9. This difference enters into the input of the amplifier 7 and, via a non-linear member 10, as amplifier desired limit value, into the input 11 of the control amplifier 3. In the control amplifier the amplified desired limit value has at first no direct effect since the correcting variable produced by it lies between the upper operating limit $y_1$ and the lower operating limit $y_2$.

The above action of the limiter changes as soon as, at the time $t_1$, a sudden drop in speed in the actual-speed value occurs, for instance because the gas pedal is released. In this case, the rapidly dropping speed is opposed by not only the control amplifier 3 since the latter, due to its slowly established integration process, cannot within a short time cause any substantial change in the correcting variable. Nevertheless, the correcting variable increases almost instantaneously at the time $t_1$, as can be noted from FIG. 3, due to the action of the limiter: In the time member 12 the change in speed is differentiated so that after the above-described subtraction of the desired value and the correcting variable the amplifier 7 of the limiter is acted on by a correspondingly large pulse. This amplified pulse passes via the non-linear member 10, which is connected, in the sense of controlling the lower operating limit, to the input 11 of the control amplifier 3. The amplified desired limit value at the input 11 causes a sudden increase in the lower operating limit within the control amplifier 3 corresponding to the differentiated time action of the actual speed. Since the correcting variable cannot be less than the lower operating limit, it is increased to a value which in FIG. 3 conforms to the course of the lower operating limit. This means that the correcting variable increases suddenly corresponding to the time action of the time member 12 in order to counteract the speed drop $x_i$. When the descending change in speed disappears, the lower operating limit also goes back, similar to the time action of the time member 12. The course of the correcting variable again moves away from the course of the lower operating limit with the correspondingly smaller output variables of the amplifier 7. The correcting variable is formed from the control deviation corresponding to the slowly integrating time action of the control amplifier 3, in which connection both short-time variations of the actual speed and of the control variation have no effect on the correcting variable since the integrating control amplifier has a smoothing function. As a result of the time member with differentiating time action 12, the small brief variations of the actual speed value also have a strong effect on the output variable of the amplifier 7 which supplies the amplified desired limit value. The variations in the amplified desired limit value which go hand in hand therewith, however, have no influence on the correcting variable since during approximately constant actual-speed value the correcting variable again is at a distance from the lower operating limit and is thus not influenced by the latter.

Figure 2:
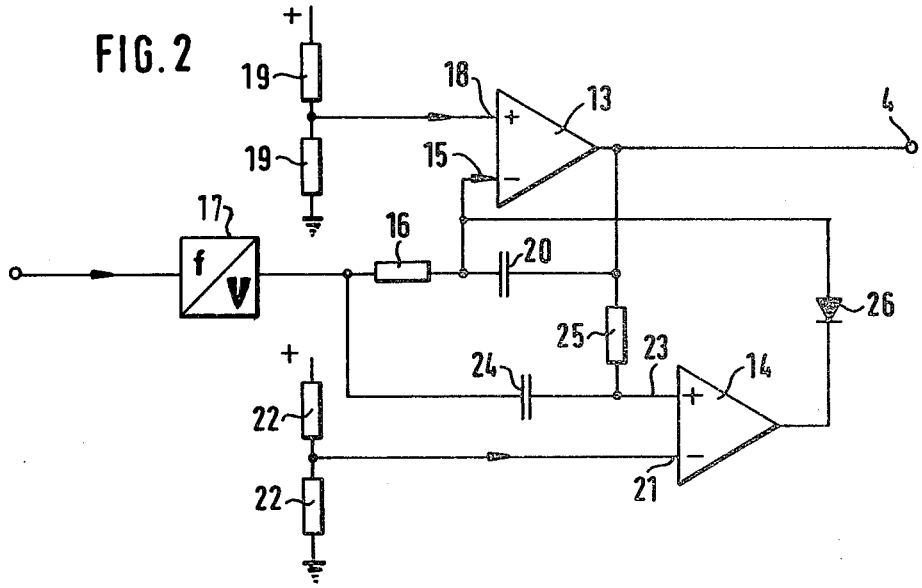
FIG. 2 is a circuit diagram of one embodiment of the idling controller.

In a less expensive embodiment of the idling controller shown in FIG. 2 a first differential amplifier 13 is provided as control amplifier and a second differential amplifier 14 as limiter amplifier. These differential amplifiers serve not only for amplification but at the same time also to form the comparison and the time action.

For this purpose, an inverting input 15 of the first differential amplifier 13 is connected via a resistor 16 to the output of a converter 17 which converts the actual-speed value into a corresponding voltage. The non-inverting input 18 of the first differential amplifier is connected to a voltage divider 19 on which a desired value of the idle speed can be set. The output of the amplifier 13 is negatively fed back via a capacitor 20 to the inverting input 15 of the first differential amplifier. The capacitor 20 in combination with the resistor 16 forms the integrating time action of the first differential amplifier.

The second differential amplifier 14, the limiter amplifier, is connected via its inverting input 21 to a voltage divider 22 and to the output of the converter 17. The voltage divider serves to predetermine the desired value for the limitation. The non-inverting input 23 of the second differential amplifier is also connected to the output of the converter 17, namely via a capacitor 24 which, in combination with a resistor 25, produces a differentiating time action. The resistor 25 connects the output of the amplifier 13 to the non-inverting input 23 of the amplifier 14.

The embodiment of the idling controller shown in FIG. 2 operates in the same way as the above-described structure of FIG. 1. In this connection the formation of the difference of the control deviation and the formation of the integral time portion at the first differential amplifier 13 and the formation of the differential time portion as well as the formations of the differences for the production of the amplified desired limit value are effected by the second differential amplifier 14.

A diode 26 connects the output of the second differential amplifier 14 with the inverting input 15 of the first differential amplifier 13 in such a manner that the lower operating limit is raised when the speed and thus the voltage at the output of the converter 17 drops. Upon large sudden drops in speed the correcting varible at the output 4 of the first control amplifier is again compelled to follow the lower operating limit while in the case of only small and/or slow variations in speed the formation of the correcting variable takes place uniformly independently of the lower operating limit which reproduces speed variations differentiated and amplified.

I claim:

1. In an idling controller, particularly for automotive vehicles, having both a control amplifier with integral time portion and a limiter with proportional time portion, the inputs of which are acted on by a correcting variable from the output of the control amplifier and by a limiter reference variable formed with the actual-speed value and the output of which is fed back to an input of the control amplifier, the improvement comprising at least one time member with differential time portion connected in a branch between an input of the actual-speed value and circuitry of the limiter, and said limiter is so dimensioned and coupled with the output of the control amplifier that upon a sudden drop in speed beyond a predetermined value, the correcting variable follows the output variable of the limiter.

2. The idling controller as set forth in claim 1, wherein the control amplifier is formed exclusively with an integral time portion.

3. The idling controller as set forth in claim 1, having a first differential amplifier as the control amplifier and a second differential amplifier, said limiter including said second differential amplifier as a limiter amplifier, said limiter further comprising a capacitor, a resistor and a diode, a bias voltage divider, and wherein a non-inverting input of the limiter amplifier is acted on by the actual-speed value coupled via said capacitor, and an inverting input of said limiter amplifier is connected with said bias voltage divider, and wherein the output of the first differential amplifier is connected via said resistor with the non-inverting input of the limiter amplifier, the diode connects the output of the limiter amplifier to an inverting input of the first differential amplifier.

4. The idling controller as set forth in claim 2, having a first differential amplifier as the control amplifier and a second differential amplifier, said limiter including said second differential amplifier as a limiter amplifier, said limiter further comprising a capacitor, a resistor and a diode, a bias voltage divider, and wherein a non-inverting input of the limiter amplifier is acted on by the actual-speed value coupled via said capacitor, and an inverting input of said limiter amplifier is connected with said bias voltage divider, and wherein the output of the first differential amplifier is connected via said resistor with the non-inverting input of the limiter amplifier, the diode connects the output of the limiter amplifier to an inverting input of the first differential amplifier.

5. The idling controller as set forth in claim 2, wherein said limiter comprises a differential amplifier, a non-linear circuit element coupling an output terminal of said differential amplifier to an input terminal of said control amplifier, and reference circuit means for driving said differential amplifier with a motor speed signal of said actual-speed value, said reference circuit means comprising a first and a second capacitor and a first and a second resistor, said first resistor and said second resistor being connected in a series circuit by said second capacitor, said series circuit being connected in parallel with said first capacitor, and wherein said first resistor is further connected between an input terminal of said reference circuit means and said non-linear circuit element.

6. The idling controller as set forth in claim 5, wherein said first capacitor and said second resistor produce a differenting time function.

* * * * *